US008243884B2

(12) United States Patent
Rödhammer et al.

(10) Patent No.: US 8,243,884 B2
(45) Date of Patent: Aug. 14, 2012

(54) X-RAY ANODE HAVING IMPROVED HEAT REMOVAL

(75) Inventors: Peter Rödhammer, Ehenbichl (AT); Wolfgang Glatz, Reutte (AT); Bernhard Tabernig, Reutte (AT); Hannes Wagner, Reutte (AT)

(73) Assignee: Plansee SE, Reutte/Tirol (AT)

( * ) Notice: Subject to any disclaimer, the term of this patent is extended or adjusted under 35 U.S.C. 154(b) by 120 days.

(21) Appl. No.: 12/680,427

(22) PCT Filed: Sep. 25, 2008

(86) PCT No.: PCT/AT2008/000343

§ 371 (c)(1),
(2), (4) Date: Mar. 26, 2010

(87) PCT Pub. No.: WO2009/039545

PCT Pub. Date: Apr. 2, 2009

(65) Prior Publication Data

US 2010/0316193 A1 Dec. 16, 2010

(30) Foreign Application Priority Data

Sep. 28, 2007 (AT) ..... GM583/2007 U

(51) Int. Cl.
*H01J 35/10* (2006.01)

(52) U.S. Cl. ..... 378/141; 378/119

(58) Field of Classification Search ..... 378/119, 378/125, 127, 128, 129, 143, 141
See application file for complete search history.

(56) References Cited

U.S. PATENT DOCUMENTS

| | | | |
|---|---|---|---|
| 6,031,285 | A | 2/2000 | Nishibayashi |
| 6,132,812 | A | 10/2000 | Rödhammer et al. |
| 7,197,119 | B2 | 3/2007 | Freudenberger et al. |

FOREIGN PATENT DOCUMENTS

| | | | | |
|---|---|---|---|---|
| DE | 10128245 | A1 | | 6/2002 |
| DE | 102004003370 | A1 | | 8/2005 |
| EP | 0874385 | A1 | | 10/1998 |
| EP | 0898310 | A2 | | 2/1999 |
| FR | 00007735 | A | * | 6/2000 |
| JP | 2002093355 | A | | 3/2002 |

* cited by examiner

*Primary Examiner* — Hoon Song
(74) *Attorney, Agent, or Firm* — Laurence A. Greenberg; Werner H. Stemer; Ralph E. Locher

(57) ABSTRACT

An X-ray anode includes a coating and a support body. In addition to a strength-imparting region, the support body has a region formed of a diamond-metal composite material. The diamond-metal composite material is formed of 40 to 90% by volume diamond particles, 10 to 60% by volume binding phase(s) formed of a metal or an alloy of the metals of the group consisting of Cu, Ag, Al and at least one carbide of the elements of the group consisting of Tr, Zr, Hf, V, Nb, Ta, Cr, Mo, W, B, and Si. The highly heat-conductive region can be form-lockingly connected at the back to a heat-dissipating region, for example formed of Cu or a Cu alloy. The X-ray anode has improved heat dissipation and lower composite stress.

20 Claims, 1 Drawing Sheet

X-RAY ANODE HAVING IMPROVED HEAT REMOVAL

BACKGROUND OF THE INVENTION

Field of the Invention

The invention relates to an X-ray anode which comprises a coating which generates X-rays on bombardment with focused electrons and is joined to a support body. The support body comprises a strength-imparting region composed of a material having a strength at 500° C. of greater than 100 MPa.

In the generation of X-rays by bombardment of an anode material with a focused electron beam, about 99% of the radiant energy is converted into heat. The focal spot is therefore subjected to very high specific inputs of energy per unit area which are in the order of magnitude of from 10 to 100 $MW/m^2$. This results in very high focal spot temperatures and in the case of pulsed electron bombardment of rotating X-ray anodes thermomechanical fatigue of the focal track. The limit of possible energy input is given by aging of the focal track combined with a progressive decrease in the dose performance and/or with the loss of the high-voltage stability of the tubes. To slow these effects, optimized removal of heat from the focal spot or the focal track is necessary.

The largest part by far of the radiation sources used in X-ray computer tomography are rotating X-ray anodes in which the energy of the electron beam brought into line focus is distributed around a ring, known as the focal track, by rotation of the anode at high speed. The energy introduced during recording of the image of up to some megajoules is firstly mostly temporarily stored in the X-ray anode and, in particular, given off to the surrounding cooling medium during the pause between recording of images by radiation, in the case of rotational anodes having a sliding groove bearing also by heat conduction into the bearing.

Rotating anodes according to the prior art comprise a coating which generates X-rays on bombardment with focused electrons, for example a coating composed of a tungsten-rhenium alloy, which is applied to a support body, for example a disk composed of a molybdenum-based material. A molybdenum-based material customary for this application is TZM having the composition Mo-0.5% by weight of Ti-0.08% by weight of Zr-0.04% by weight of C. Depending on the field in which the anode is used, a graphite body can be soldered onto the rear side of the metal disk in order to increase the heat storage capacity and radiation of heat. At the initial temperature for operation of the tube (about 40° C.), the thermal conductivities of W-10% by weight of Re, TZM and graphite are about 85, 125 and 135 W/m·K, respectively, but decrease significantly with increasing anode temperature.

In a new generation of X-ray tubes, known as rotary tubes, the anode is fixed as base to a tube which rotates as a whole and the anode is actively cooled on the rear side. The energy balance of the anode is dominated by the removal of heat into the cooling medium. Heat storage plays a minor role. DE 10 2005 039 188 B4 describes an X-ray tube having a cathode and an anode made of a first material, with the anode being provided on its first side facing away from the cathode with, at least in sections, a heat conducting element made of a second material which has a higher thermal conductivity than the first material in order to conduct away heat, where the second material has a thermal conductivity of at least 500 W/mK and the second material is made of titanium-doped graphite.

DE 10 2004 003 370 A1 describes a high-performance anode base for a directly cooled rotary tube, which base comprises a high-temperature-resistant material such as tungsten, molybdenum or a composite of the two materials, with the underside of the anode base in the region of the focal point track being shaped and/or another highly thermally conductive material being introduced or applied in this region in such a way that improved heat removal and thus a lower temperature gradient within this region of the material is obtained. Copper is mentioned as material having a high thermal conductivity.

There have been numerous approaches to improving the heat removal in rotating X-ray anodes in past years. Despite the excellent thermal conductivity of diamond at room temperature, diamond received little attention because of the sharply decreasing thermal conductivity at elevated temperatures and the conversion into graphite at T>1100° C. Thus, U.S. Pat. No. 4,972,449 proposed the use of a diamond layer intercalated between the coating and the support body. However, diamond also has a significantly lower coefficient of expansion than the adjacent materials, as a result of which stresses are induced in the composite body. Furthermore, the classical powder-metallurgical production route for X-ray anodes, namely the powder-metallurgical joining of focal track coating and support body, cannot be employed since the sintering process would lead to conversion of the diamond layer into graphite. X-ray anodes according to U.S. Pat. No. 4,972,449 can therefore only be produced by coating methods, for example CVD processes.

BRIEF SUMMARY OF THE INVENTION

It is therefore an object of the present invention to provide an X-ray anode which has a support body having improved heat removal. A further object is to reduce the stresses in the composite of support body/coating.

The X-ray anode comprises a coating and a support body, with the support body comprising a strength-imparting region and also a region composed of a diamond-metal composite. The diamond-metal composite comprises diamond grains surrounded by binder phase(s). The binder phase(s) comprises/comprise a binder metal, preferably a binder metal based on copper, silver, aluminum and alloys of these materials, and also optionally up to 20% by volume of carbides. Varying the diamond content and binder phase content makes it possible to match the diamond-metal composite to the surrounding materials in terms of thermal conductivity and thermal expansion in such a way that tailored solutions for a wide variety of requirements are possible. A gradated structure of the diamond-metal composite in which the proportion of diamond is highest near the coating and decreases in the direction of the maximum heat flow can be advantageous. In this way, it is possible to achieve minimization of the stresses in the composite caused by different coefficients of thermal expansion of the materials used. Furthermore, diamond powder can be processed with a broad particle size spectrum. Preferred particle sizes are in the range from 50 to 400 μm, ideally from 100 to 250 μm. Apart from natural diamonds, it is also possible to process cheaper synthetic diamonds in this way. The preferred proportion by volume of the diamond grains is from 40 to 90% by volume, and that of the binder phase(s) is from 10 to 60% by volume. A diamond content of from 40 to 90% by volume ensures that the stresses in the composite are reliably reduced to a level which is not critical for use. Particularly advantageous diamond contents and binder phase contents are from 50 to 70% by volume and from 30 to 50% by volume, respectively.

The binder metal preferably comprises from 80 to 100 atom % of at least one matrix metal from the group consisting of Cu, Ag, Al, from 0 to 20 atom % of a metal having a solubility at room temperature in the matrix metal of less than 1 atom % and from 0 to 1 atom % of a metal having a solubility at room temperature in the matrix metal of greater than 1 atom %, balance production-related impurities. Alloying elements having a solubility at room temperature in the matrix metal of less than 1 atom % reduce the thermal conductivity to a small extent and can therefore be present in amounts of up to 20 atom %, while alloying elements having a solubility of greater than 1 atom % are restricted to 1 atom % because of their adverse effect on the thermal conductivity.

Good bonding between the diamond phase and metal phase is necessary in order to ensure a transition from the phonon conductivity of diamond to the electron conductivity of the binder metal. This can be achieved, for example, by formation of a carbidic phase located between the diamond phase and the metal phase. Studies have shown that even carbide films having a thickness of a few layers of atoms significantly improve the thermal conductivity. Carbide-forming elements which have been found to be useful are the metallic elements of groups 4b (Ti, Zr, Hf), 5b (V, Nb, Ta), 6b (Cr, Mo, W) of the Periodic Table and also B and Si. The weak carbide formers Si and B are particularly suitable. When the matrix metal is a carbide-forming element such as aluminum, the addition of further carbide-forming elements can be omitted. Furthermore, it is advantageous for the element forming the carbidic phase also to be present in the binder metal. Preference is given to the carbide-forming elements which have a solubility in the respective matrix metal of less than 1 atom %. If the solubility is greater, the thermal conductivity of the binder metal and thus that of the diamond-metal composite are again reduced. Preferred compositions of the binder metal are aluminum materials comprising from 0.005 to 3 atom % of one or more of the elements V, Nb, Ta, Ti, Zr, Hf, B, Cr, Mo, W and/or comprising from 0.005 to 20 atom % of Si.

On the basis of Ag, these are materials comprising from 0.005 to 5 atom % of one or more elements of the group Zr, Hf and/or from 0.005 to 10 atom % of one or more elements of the group V, Nb, Ta, Cr, Mo, W and/or from 0.005 to 20 atom % of Si. Particularly advantageous properties are achieved using Cu-based matrix metals which are alloyed with from 0.005 to 3 atom % of one or more elements of the group Ti, Zr, Hf and/or from 0.005 to 10 atom % of one or more elements of the group Mo, W, B, V, Nb, Ta, Cr, and/or from 0.005 to 20 atom % of B. Ag alloys with from 0.1 to 12 atom % of Si and Cu alloys with from 0.1 to 14 atom % of boron, balance usually impurities have been found to be particularly advantageous binder metals.

A particularly advantageous effect can also be achieved when coated diamond powders (metallic or carbidic layer) are used.

The use of the diamond-metal composite according to the invention makes it possible to conically widen the heat flow and thus increase the efficiency of active cooling in the case of actively cooled X-ray anodes. Comprehensive experiments on such X-ray anodes have shown that the solution according to the invention reduces the temperature to such an extent that the predicted low thermal conductivity of the diamond-metal composite at elevated use temperatures still does not have a function-limiting effect.

Since the diamond-metal composites according to the invention have limited mechanical properties such as tensile and compressive strength, fracture toughness and fatigue strength and can accordingly not be thermally cycled as free-standing structure under use conditions of X-ray anodes, the support body comprises not only the diamond-metal composite but also a strength-imparting region of a structural material which has a strength at 500° C. of greater than 100 MPa. The diamond-metal composite is protected against interfering deformation or initiation of cracks caused by centrifugal forces or thermomechanical stresses by the structural stiffness of the structural component. This makes it possible to optimize the diamond-metal composite firstly in respect of thermal conductivity, in particular by increasing the proportion of diamond. Secondly, the diamond-metal composite can be matched in terms of its thermal expansion to the structural material. In this way, the functions of the support body can be decoupled from firstly structural strength and rupture strength and secondly heat removal. Particularly suitable structural materials which may be mentioned are Mo, Mo alloys, W, W alloys, W—Cu composites, Mo—Cu composites, particle-reinforced Cu alloys and particle-reinforced Al alloys. As particularly advantageous molybdenum alloys, mention may be made of TZM (Mo-0.5% by weight of titanium-0.08% by weight of zirconium-0.04% by weight of C) and MHC (Mo-1.2% by weight of Hf-0.08% by weight of C).

The region of the diamond-metal composite can directly adjoin the coating. This is possible and appropriate when the temperature on the rear side of the coating can be reduced by the diamond-metal composite to such an extent that no damage to the material, for example melting of the binder phase(s) of the diamond-metal composite, occurs. If this is not the case, it is advantageous for the strength-imparting region composed of a structural material which is stable under use conditions, preferably molybdenum, tungsten or an alloy of these metals, to extend between the diamond-metal composite and the coating.

The diamond-metal composite is preferably arranged under that region of the coating in which heat arises due to the action of the electron beam. In the case of a rotating X-ray anode, this is the ring-shaped focal track. This gives preferred embodiments for the region of the diamond-metal composite, namely regions having an axially symmetrical geometry, for example a disk or a ring. The cross section is preferably approximately rectangular or trapezoidal.

Viewed in the direction of the maximum heat flow, it is also advantageous for the region of the diamond-metal composite to be followed by a further heat-removing region composed of a highly thermally conductive metal which can be given its final shape, in particular in respect of the construction of cooling structures, by means of conventional cutting machining processes. As highly thermally conductive metals, mention may be made of copper, aluminum, silver and alloys thereof. This heat-removing region is also preferably configured as a ring-shaped element or as a disk and firmly bonded to the diamond-metal composite and/or the strength-imparting region.

In the direction of maximum heat flow, the X-ray anode preferably has the following structure at least in the region of the maximum heat stress:

from 0.01 mm to 1 mm coating, from 0 to 4 mm strength-imparting region, from 2 to 15 mm region of the diamond-metal composite and from 0 to 10 mm heat-removing region. A minimum thickness of the coating of 0.01 mm can is necessary for X-ray-physical reasons. At coating thicknesses above 1 mm and/or a thickness of the strength-imparting region above 4 mm, the heat removal is reduced since the W—Re alloys which are customarily used and the structural materials available have a reduced thermal conductivity compared to the diamond-metal composite. It is particularly advantageous for the thickness of the coating to be from 0.2 to 0.4 mm and that of the strength-imparting region to be from 0.5 to 4 mm.

The inventive structure of an X-ray anode can be employed particularly advantageously, in particular, in the case of rotating anodes and when the rotating anode is in turn used as actively cooled bottom of a rotary tube. To achieve sufficient structural strength of the rotating anode, it is found to be useful for the center to be formed by only the structural material. Furthermore, it is advantageous for the region of the diamond-metal composite to be embedded as ring- or disk-shaped element in an appropriate depression of the strength-imparting region of the support body and thus be supported by the latter against mechanical stresses which occur. The structural material is advantageously firmly bonded on one side to the coating and on the other side to the diamond-metal composite. The firmly bonding of the structural component and the diamond-metal composite can advantageously be carried out in situ during the synthesis in suitable recesses in the strength-imparting region of the anode body (for example by pressure infiltration or by hot isostatic pressing). On the other hand, it is possible to synthesize the composite on its own and produce a body of suitable shape therefrom and then firmly bond this body to the structural component, for example by soldering or another known joining process.

To produce the diamond-metal composite, there are a number of available processes in which the binder metal is firmly bonded to the diamond either via the melt phase or via the solid phase. Via the melt phase, the processes advantageously proceed by means of pressure infiltration. Typical infiltration temperatures are about 100° C. above the respective melting point of the binder metal. Reactions with the diamond grain then may form the abovementioned carbide phases enveloping the diamond grains.

A particularly suitable production process comprises the following production steps:

- production of a composite body made up of the structural material and the coating material by powder-metallurgical composite pressing/sintering/forging or application of the coating material to the structural material by vacuum plasma spraying;
- introduction of a depression into the structural material on the side facing away from the coating;
- introduction of diamond powder having a particle size of from 50 to 400 μm into the depression, with the diamond powder being able to be uncoated or coated (layer thickness from 0.05 to 50 μm) preferably with a metal or a carbide of a metal of groups 4b, 5b, 6b of the Periodic Table, B and Si;
- infiltration of the diamond powder bed with the binder metal at a pressure of from 1 to 500 bar and a temperature T such that the liquidus temperature of the binder metal<T<liquidus temperature of the binder metal plus 200° C.; optionally with an excess of the binder metal, to form the heat-removing region;
- machining.

In the production of the bond between diamond grain and binder metal in the solid phase, the bond between the diamond grain and the binder metal is formed by diffusion. The required diffusion paths can be achieved even at temperatures T of ~0.5-0.8 $T_m$ ($T_m$=melting point of the binder metal in degrees kelvin) and hold times of a few hours. Suitable processes are, for example, hot pressing and hot isostatic pressing of diamond/metal powder mixtures. Bonding is advantageously improved or accelerated by means of suitable coatings on the diamond grains. In the case of the solid-phase reaction, it is possible, with appropriate pretreatment of the diamond grains and selection of the consolidation conditions, to reduce the contents of additive materials by orders of magnitude or possibly dispense with these entirely, as a result of which the high thermal conductivity of the pure binder phase can largely be retained.

Combinations of the two reaction routes, for example brief passing through the melt phase under super-atmospheric pressure for pore-free backfilling of the diamond bed followed by a solid-state pressure diffusion phase at decreased temperatures, can also be advantageous, in particular for achieving high proportions of diamond in the composite.

A particularly suitable process comprises the production steps:

- production of a composite body made up of the structural material and the coating material by powder-metallurgical composite pressing/sintering/forging or application of the coating material to the structural material by vacuum plasma spraying;
- introduction of a depression into the structural material on the side facing away from the coating;
- introduction of a mixture of diamond powder and the binder metal into the depression, with the diamond powder having a particle size of from 50 to 400 μm and being able to be uncoated or coated (layer thickness from 0.05 to 50 μm) preferably with a metal or a carbide of a metal of groups 4b, 5b, 6b of the Periodic Table, B and Si;
- hot pressing of the mixture at a pressure of from 10 to 200 MPa and a temperature T such that 0.6× solidus temperature of the binder metal<T<solidus temperature of the binder metal; optionally with an excess of the binder metal, to form the heat-removing region;
- machining.

A further suitable process comprises the production steps:

- production of a composite body made up of the structural material and the coating material by powder-metallurgical composite pressing/sintering/forging or application of the coating material to the structural material by vacuum plasma spraying;
- introduction of a depression into the structural material on the side facing away from the coating;
- production of a green body by pressing of a mixture of diamond powder and binder metal powder, with the diamond powder having a particle size of from 50 to 400 μm and the binder metal powder having a particle size of from 0.5 to 600 μm and the diamond powder being able to be uncoated or coated (layer thickness from 0.05 to 50 μm) preferably with a metal or a carbide of a metal of groups 4b, 5b, 6b of the Periodic Table, B and Si, at a pressure of preferably from 70 to 700 MPa;
- introduction of the green body into the depression of the structural material and canning of the assembly produced in this way using customary canning materials (for example steel, titanium);
- hot isostatic pressing of the canned assembly at a pressure of from 50 to 300 MPa and a temperature T such that 0.6× solidus temperature of the binder metal<T<liquidus temperature of the binder metal plus 200° C.; optionally with an excess of the binder metal, to form the heat-removing region
- machining.

Further processes, in particular processes for producing composites, e.g. gas-phase infiltration of the binder metal, are in principle also possible for producing the diamond-metal composite.

BRIEF DESCRIPTION OF THE SEVERAL VIEWS OF THE DRAWING

The invention is illustrated below by means of examples.

DESCRIPTION OF THE INVENTION

Example 1

Figure 1:
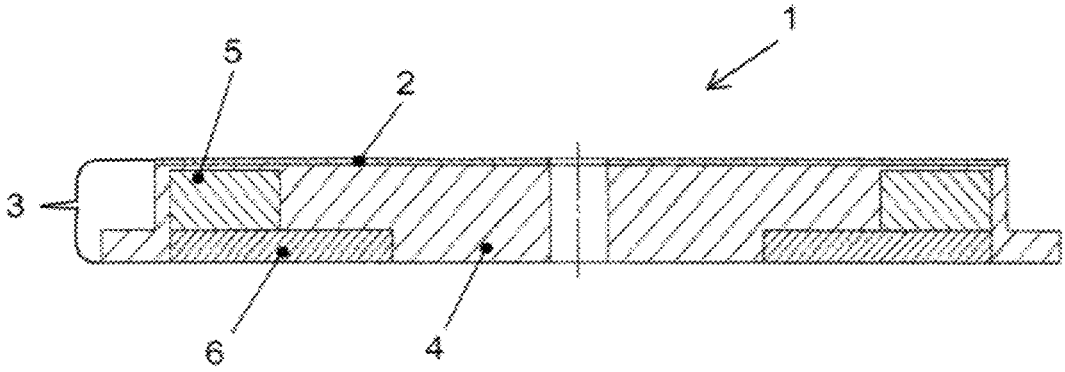
FIG. 1 schematically shows the cross section of the X-ray anode according to the invention as per example 4

To produce the binder phase based on Cu, disks of the high-strength Mo alloy TZM (Mo-0.5% by weight of Ti-0.08% by weight of Zr-0.01 to 0.06% by weight of C) having a diameter of 50 mm and a thickness of 30 mm were produced by a conventional powder-metallurgical route via powder pressing/sintering/forging. A cylindrical depression having a diameter of 30 mm and a depth of 20 mm was machined into these disks. In the following working step, a diamond bed having an average particle diameter (determined by laser light scattering) of 150 μm was introduced in each case into the depression formed in this way and the ring-shaped depression was infiltrated with Cu alloys having the following compositions: Cu-0.5 atom % of B, Cu-2 atom % of B and Cu-8 atom % of B by gas pressure infiltration to produce the diamond-metal composite.

In addition, Nb-coated (layer thickness about 1 μm) diamond powder having an average particle diameter (determined by laser light scattering) of 150 μm was introduced into the ring-shaped depression and pure Cu in particulate form was positioned above it. Identical experiments were carried out using Cr-, Ti- and Mo-coated powders. The gas pressure infiltration was in each case carried out under an Ar protective gas atmosphere at 1100° C. and a gas pressure of 2 bar. The proportion by volume of diamond was about 55% in all specimens. The thermal conductivity of the Cu-diamond composites at 500° C. was in the range from 290 to 350 W/m·K.

Example 2

To produce the binder phase based on Ag, disks as described in example 1 were produced. To produce the diamond-metal composite, a diamond bed having an average particle diameter (determined by laser light scattering) of 150 μm was in each case introduced into the depression and the ring-shaped depression was infiltrated with Ag alloys of the following compositions: Ag-0.5 atom % of Si, Ag-3 atom % of Si, Ag-11 atom % of Si and Ag-18 atom % of Si by gas pressure infiltration.

In addition, Nb-coated (layer thickness about 1 μm) diamond powder having an average particle diameter (determined by laser light scattering) of 150 μm was introduced into the ring-shaped depression and pure Ag in particulate form was positioned above it. Identical experiments were carried out using Cr-, Ti- and Mo-coated powders. The gas pressure infiltration was in each case carried out under an Ar protective gas atmosphere at 1000° C. and a gas pressure of 2 bar. The proportion by volume of diamond was about 55% in all specimens. The thermal conductivity of the Ag-diamond composites at 500° C. was in the range from 340 to 440 W/m·K.

Example 3

To produce the binder phase based on Al, disks as described in example 1 were produced. To produce the diamond-metal composite, a diamond bed having an average particle diameter (determined by laser light scattering) of 150 μm was in each case introduced into the depression and the ring-shaped depression was infiltrated with Al materials of the following compositions: Al, Al-3 atom % of Si, Al-12 atom % of Si and Al-15 atom % of Si by gas pressure infiltration.

In addition, Nb-coated (layer thickness about 1 μm) diamond powder having an average particle diameter (determined by laser light scattering) of 150 μm was introduced into the ring-shaped depression and pure Al in particulate form was positioned above it. Identical experiments were carried out using Cr-, Ti- and Mo-coated powders. The gas pressure infiltration was in each case carried out under an Ar protective gas atmosphere at 700° C. and a gas pressure of 2 bar. The proportion by volume of diamond was about 55% in all specimens. The thermal conductivity of the Al-diamond composites at RT was in the range from 400 to 450 W/m·K.

Example 4

A rotating anode -1- having a structure as shown in FIG. 1 was produced as follows: the strength-imparting region -4- of the support body -3- was produced from TZM by a conventional powder-metallurgical route by means of powder pressing/sintering/forging and turning of the front contour (having an external diameter of 125 mm). The X-ray producing coating -2- composed of W-5% by weight of Re was then applied by means of vacuum plasma spraying. A ring-shaped region having a width of 25 mm was turned out of the strength-imparting region -4- of the support body -3- below the coating -2- to leave a residual thickness of the strength-imparting region -4- of 1 mm. In the following working step, a diamond bed having an average particle diameter (determined by laser light scattering) of 150 μm was introduced into the resulting ring-shaped groove to produce the region -5- of the diamond-metal composite and the ring-shaped depression was infiltrated with a Cu-4 atom % of B alloy which was positioned in particulate form on the diamond powder bed by gas pressure infiltration. The gas pressure infiltration was carried out under an Ar protective gas atmosphere at 1100° C. using a gas pressure of 2 bar. Utilizing a suitable graphite tool, the heat-removing region -6- in the form of a Cu-4 atom % of B backing plate having a thickness of 3.7 mm was cast behind the diamond composite simultaneously with the infiltration. To improve heat transfer to the cooling medium, a fin structure was machined into this backing plate. The resulting region -5- composed of the diamond-metal composite had a proportion by volume of about 55% of diamond and a coefficient of expansion at RT of 6.5 $E^{-6}/°$ K. The thermal conductivity of the Cu-diamond composite was 480 W/m·K at 22° C. and 350 W/m·K at 500° C.

Example 5

Figure 2:
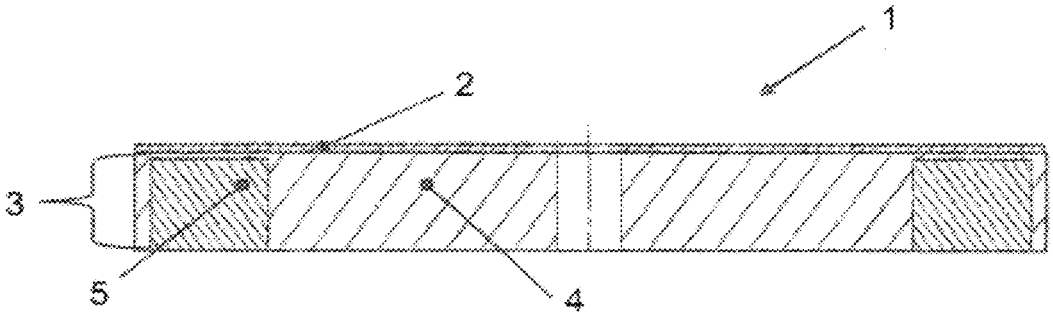
FIG. 2 schematically shows the cross section of the X-ray anode according to the invention as per example 5

A rotating anode -1- having a structure as shown in FIG. 2 was made as follows. The strength-imparting region -4- of the support body -3- was produced from the high-strength Mo alloy MHC (Mo-1.2% by weight of Hf-0.04-0.15% by weight of C), with the X-ray-producing coating -2- composed of W-10% by weight of Re being joined to the strength-imparting region -4- by the customary powder-metallurgical method by means of copressing/sintering and bonding forging. The ring-shaped groove was produced as described in example 4. In the following working step, a diamond bed having an average particle diameter of 150 (determined by laser light scattering) was introduced into the machined ring-shaped groove to produce the region -5- composed of the diamond-metal composite. An Ag-11 atom % of Si alloy in particulate form was positioned on the diamond bed. The infiltration was carried out under an Ar protective gas atmosphere at 1000° C. using a gas pressure of 2 bar. The region -5- was concluded on the underside of the rotating anode -1- with an excess of metal melt having a thickness of about 2 mm. The use of the Ag matrix enabled a thermal conductivity of 590 W/m·K at 22° C. and 420 W/m·K at 500° C. to be achieved.

Example 6

Figure 3:
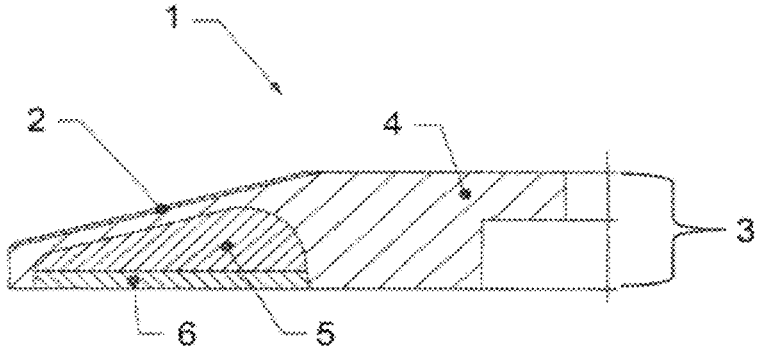
FIG. 3 schematically shows the cross section of the X-ray anodes according to the invention as per examples 6 and 7

A rotating anode -1- having a structure as shown in FIG. 3 was produced as follows. The production of the strength-imparting region -4- composed of TZM (thickness 15 mm, diameter 140 mm) and application of the coating -2- composed of W-5% by weight of Re were carried out in a manner analogous to example 4. A groove was turned in the strength-imparting region -4- of the support body -3- in the ring-shaped region (external diameter 125 mm, internal diameter 80 mm) to be backfilled with diamond-metal composite to leave a residual thickness of the TZM of 1 mm. The strength-imparting region -4- together with a ring-shaped coating disk built up thereon formed part of the hot-pressing tool which was backfilled with a mixture of 50% by volume of diamond and 50% by volume of high-purity copper to form the region -5-. The diamond grains had a diameter of 150 μm (determined by laser light scattering) and were coated with 1 μm of SiC for later bonding of the matrix. The high-purity Cu powder likewise had a particle diameter of 150 μm. Finally, a covering bed of 3 mm copper powder having the same particle size was applied to form the heat-removing region -6-. This bed was prepressed at room temperature and hot pressed at a temperature of 900° C. for 1.5 hours at a pressure of 40 MPa and in this way densified to 99.8% of the theoretical density. At the same time, a strong and readily thermally conductive bond between the diamond grains and the copper matrix and between the matrix and the support body -3- was formed by diffusion between SiC and Cu.

The thermal conductivity measured on the resulting copper-diamond composite was 490 W/m·K (at 22° C.)

Example 7

A rotating anode -1- having a structure as shown in FIG. 3 was produced as follows. The production of the strength-imparting region -4-, application of the coating -2- and production of the ring-shaped region were carried out as described in example 5. A powder bed composed of a mixture of 70% by volume of diamond and 30% by volume of silver to form the region -5- was densified by means of die pressing to give a pressed body in the approximate shape of the turned-out ring-shaped region of the strength-imparting region -4- and placed in the turned-out ring-shaped region. The diamond grains had a diameter of 300 μm and were coated with 3-5 μm of SiC. The Ag powder had a particle diameter of 150 μm. An Ag foil having a diameter of 140 mm and a thickness of 3 mm was laid onto the rear side of the diamond-Ag green body. The total structure was welded in a vacuum-tight manner into a steel can and the latter was evacuated. The Ag present was melted in the HIP process by melting at 980° C. with a hold time of 2 minutes and a pressure of 50 MPa, and the hollow spaces of the green body were thus backfilled with Ag melt. The temperature was subsequently reduced to 650° C. and the canned component was maintained under a pressure of 70 MPa for 1 hour. Cooling to room temperature was likewise carried out under super-atmospheric pressure in the range of about 70 MPa, with a hold time at 400° C. of 2 hours. The silver-diamond composite obtained in this way had a thermal conductivity of 610 W/m·K.

As reference anode for comparative tests in X-ray tubes, use was made of an anode for rotary tubes which had the same structure and was made according to the present-day state of the art but was backfilled with copper instead of diamond-metal composite.

All rotating anodes backfilled with diamond-metal composite as described in examples 4 to 7 displayed excellent use behavior when tested in rotary tubes under test conditions more severe compared to the present-day limiting load (increase in the electric power by 20% compared to the reference anodes according to the prior art) and showed a significantly slowed decrease in the X-ray dose over the test time compared to the reference anodes despite the increased load. The reduction in the roughening of the focal track, which is responsible for the decrease in the X-ray dose over the life of the anode, correlated in a good approximation with the relative increase in the thermal conductivity of the diamond-metal composite present in each case. In destructive analyses of the various anodes carried out after the end of the test, no damage to the bond between the strength-imparting component and the diamond-metal composite or within the latter between diamond grains and binder metal was observed.

The invention claimed is:

1. An X-ray anode for generating X-rays, the X-ray anode comprising:

a support body; and a coating joined to said support body for generating the X-rays upon bombardment with focused electrons;

said support body having a strength-imparting region composed of a material with a strength of greater than 100 MPa at 500° C.; and said support body having a region composed of a diamond-metal composite containing from 40 to 90% by volume of diamond grains, from 10 to 60% by volume of binder phase(s) having from 80 to 100% by volume of binder metal and from 0 to 20% by volume of at least one carbide of a metallic element from groups 4b, 5b, 6b of the Periodic Table, B and Si; and a balance of diamond and production-related impurities.

2. The X-ray anode according to claim 1, wherein said binder metal includes:

from 80 to 100 atom % of at least one matrix metal from the group consisting of Cu, Ag, Al;

from 0 to 20 atom % of a metal having a solubility at room temperature in said matrix metal of less than 1 atom % and from 0 to 1 atom % of a metal having a solubility at room temperature in said matrix metal of greater than 1 atom %; and a balance of production-related impurities.

3. The X-ray anode according to claim 1, wherein said binder metal includes:

from 0.005 to 3 atom % of one or more elements from the group consisting of Ti, Zr, Hf and/or from 0.005 to 10 atom % of one or more elements from the group consisting of Mo, W, V, Ta, Nb, Cr and/or from 0.005 to 20 atom % of B; and a balance of Cu and usual impurities.

4. The X-ray anode according to claim 1, wherein said binder metal includes:

from 0.005 to 5 atom % of one or more elements from the group consisting of Zr, Hf and/or from 0.005 to 10 atom % of one or more elements of the group consisting of V, Nb, Ta, Cr, Mo, W and/or from 0.005 to 20 atom % of Si; and a balance of Ag and usual impurities.

5. The X-ray anode according to claim 1, wherein said binder metal includes:

from 0.005 to 3 atom % of one or more elements from the group consisting of V, Nb, Ta, Ti, Zr, Hf, Cr, Mo, W, B and/or from 0.005 to 20 atom % of Si; and a balance of Al and usual impurities.

6. The X-ray anode according to claim 1, wherein said binder metal includes Al, Cu or Ag having a purity of >2N5.

7. The X-ray anode according to claim 1, wherein said region composed of diamond-metal composite is located below said coating in a region of maximum heat stress.

8. The X-ray anode according to claim 1, wherein said regions are firmly bonded by a backcasting, pressure infiltration, diffusion welding or soldering process, at least in subregions.

9. The X-ray anode according to claim 1, wherein said diamond-metal composite has a gradated structure with a proportion of diamond being highest toward said coating and decreasing in a direction of maximum heat flow.

10. The X-ray anode according to claim 1, wherein said support body includes a heat-removing region composed of Cu, Al, Ag or an alloy thereof, said heat-removing region follows said region composed of diamond-metal composite in a direction of maximum heat flow and said heat-removing region is firmly bonded to said region composed of diamond-metal composite.

11. The X-ray anode according to claim 10, which further comprises, at least in a region of maximum heat stress in said direction of maximum heat flow, from 0.01 mm to 1 mm of said coating, from 0 to 4 mm of said strength-imparting region, from 2 to 15 mm of said region composed of diamond-metal composite and from 0 to 10 mm of said heat-removing region.

12. The X-ray anode according to claim 11, wherein said strength-imparting region has a thickness of from 0.5 to 3 mm.

13. The X-ray anode according to claim 1, wherein said strength-imparting region is formed of at least a material from the group consisting of Mo, Mo alloy, W, W alloy, W—Cu composite, Cu composite, particle-reinforced Cu alloy and particle-reinforced Al alloy.

14. The X-ray anode according to claim 13, wherein said strength-imparting region is formed of 0.5% by weight of Mo, 0.08% by weight of Ti, 0.01 to 0.06% by weight of Zr, 1.2% by weight of C or Mo, 0.04 to 0.15% by weight of Hf and C.

15. The X-ray anode according to claim 1, wherein said coating is formed of a W—Re alloy containing from 1 to 10% by weight of Re.

16. The X-ray anode according to claim 1, wherein the X-ray anode is an axially symmetric rotating anode and said strength-imparting region and said region composed of diamond-metal composite are disposed axially symmetrically.

17. The X-ray anode according to claim 16, which further comprises a focal track, said region composed of diamond-metal composite being configured as a ring or disk, being positioned in a geometrically corresponding depression formed in said strength-imparting region and being firmly bonded to said strength-imparting region at least in a region below said focal track.

18. An X-ray anode for generating X-rays, the X-ray anode comprising:

a support body; and a coating joined to said support body for generating the X-rays upon bombardment with focused electrons;

said support body having a strength-imparting region composed of a material with a strength of greater than 100 MPa at 500° C., said strength-imparting region being formed of 0.5% by weight of Mo, 0.08% by weight of Ti, 0.01 to 0.06% by weight of Zr, 1.2% by weight of C or Mo, 0.04 to 0.15% by weight of Hf and C; and said support body having a region composed of a diamond-metal composite containing from 40 to 90% by volume of diamond grains.

19. An X-ray anode for generating X-rays, the X-ray anode comprising:

a support body; and a coating joined to said support body for generating the X-rays upon bombardment with focused electrons;

said support body having a strength-imparting region composed of a material with a strength of greater than 100 MPa at 500° C.;

said support body having a region composed of a diamond-metal composite containing from 40 to 90% by volume of diamond grains;

said support body including a heat-removing region composed of Cu, Al, Ag or an alloy thereof, said heat-removing region following said region composed of diamond-metal composite in a direction of maximum heat flow and said heat-removing region being firmly bonded to said region composed of diamond-metal composite; and which further comprises, at least in a region of maximum heat stress in said direction of maximum heat flow, from 0.01 mm to 1 mm of said coating, from 0 to 4 mm of said strength-imparting region, from 2 to 15 mm of said region composed of diamond-metal composite and from 0 to 10 mm of said heat-removing region.

20. The X-ray anode according to claim 19, wherein said strength-imparting region has a thickness of from 0.5 to 3 mm.

* * * * *